United States Patent [19]

Classen

[11] 4,128,976

[45] Dec. 12, 1978

[54] SPIRAL STAIR KIT

[76] Inventor: Alvin T. Classen, R.R. 4, Andy's Lake, Norfolk, Nebr. 68701

[21] Appl. No.: 775,680

[22] Filed: Mar. 8, 1977

[51] Int. Cl.[2] ..... E04F 11/00

[52] U.S. Cl. ..... 52/187

[58] Field of Search ..... 52/187, 191, 182, 185, 52/188, 190; 206/223

[56] References Cited

U.S. PATENT DOCUMENTS

| | | | |
|---|---|---|---|
| 1,031,645 | 7/1912 | Haskell | 52/187 |
| 1,361,918 | 12/1920 | Smith | 52/187 |
| 1,547,254 | 7/1925 | McClure | 52/187 |
| 3,482,364 | 12/1969 | Albrektson et al. | 52/187 |
| 3,491,498 | 1/1970 | Hughes, Jr. | 52/187 |
| 3,740,906 | 6/1973 | Schneider | 52/187 |
| 4,041,662 | 8/1977 | Ward | 52/187 |

FOREIGN PATENT DOCUMENTS

| | | | |
|---|---|---|---|
| 955861 | 4/1964 | United Kingdom | 52/187 |

*Primary Examiner*—Price C. Faw, Jr.
*Assistant Examiner*—Henry Raduazo
*Attorney, Agent, or Firm*—Sughrue, Rothwell, Mion, Zinn and Macpeak

[57] ABSTRACT

A kit for a home craftsman or do-it-yourself person to erect a spiral staircase between different floors of a house; the kit including a center column, a set of step-holder brackets for attachment to the column and to one end of step treads, another set of brackets for attachment under the opposite ends of the step treads, templates for cutting out and drilling a set of treads made of lumber for forming steps, a set of posts for forming a spiral bannister, a set of braces and shims for adjusting the distances between the step treads.

1 Claim, 10 Drawing Figures

Fig. 7
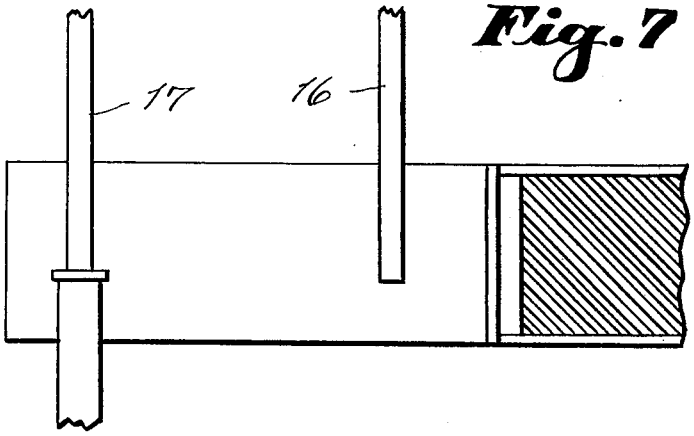
Fig. 8
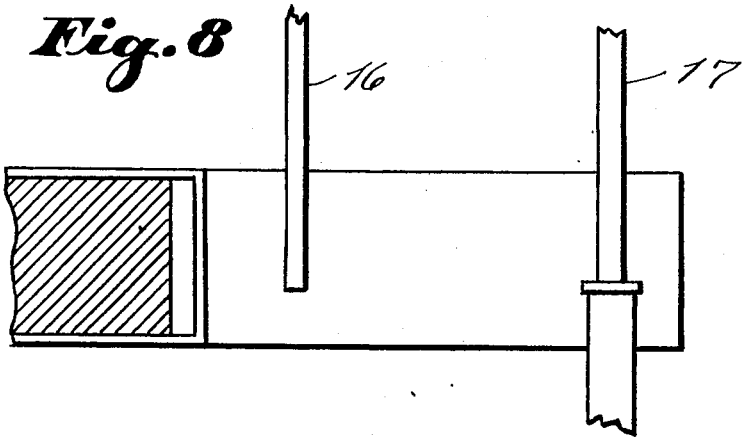
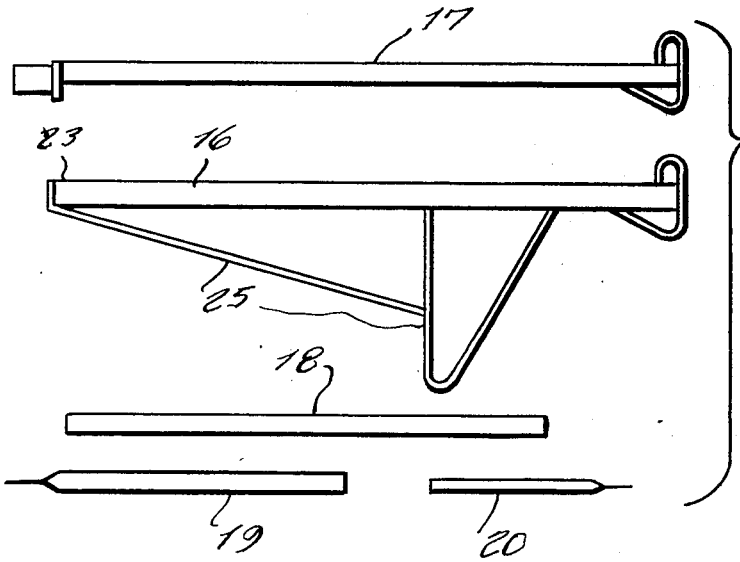
Fig. 9
Fig. 10
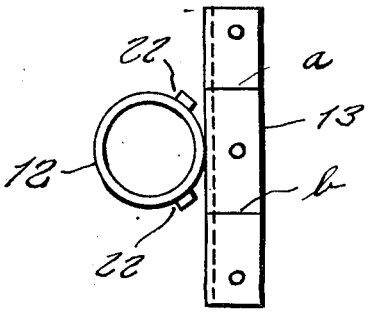

SPIRAL STAIR KIT

This invention relates generally to construction kits. More specifically it relates to stairway construction kits.

A principal object of the present invention is to provide a kit whereby any do-it-yourself person can, without great skill, easily assemble and install a spiral staircase in a house for persons to climb between lower and upper floors of a house.

Another object is to provide a kit that includes all the construction components with exception of the treads which can be made of lumber purchased at any lumber yard and which is cut and drilled according to a template provided in the kit.

Yet another object is to provide a spiral stair kit which is ideal for remodeling or which is perfect for new homes so to acquire stairs of attractive styling that are superior engineered.

Other objects are to provide a spiral stair kit which is simple in design, inexpensive to manufacture, rugged in construction, easy to use, and efficient in operation.

These and other objects will be readily evident upon a study of the following specification and the accompanying drawings wherein:

FIG. 7 is a detail in side view of the relative positions of posts and an upper floor for a left hand stairway;

FIG. 8 is a simular view for a right hand stairway;

FIG. 9 is a view of individual posts and a disassembled brace;

FIG. 10 is a top view of a step-holder bracket adjacent a column and prior to either end thereof cut off.

Figure 1:
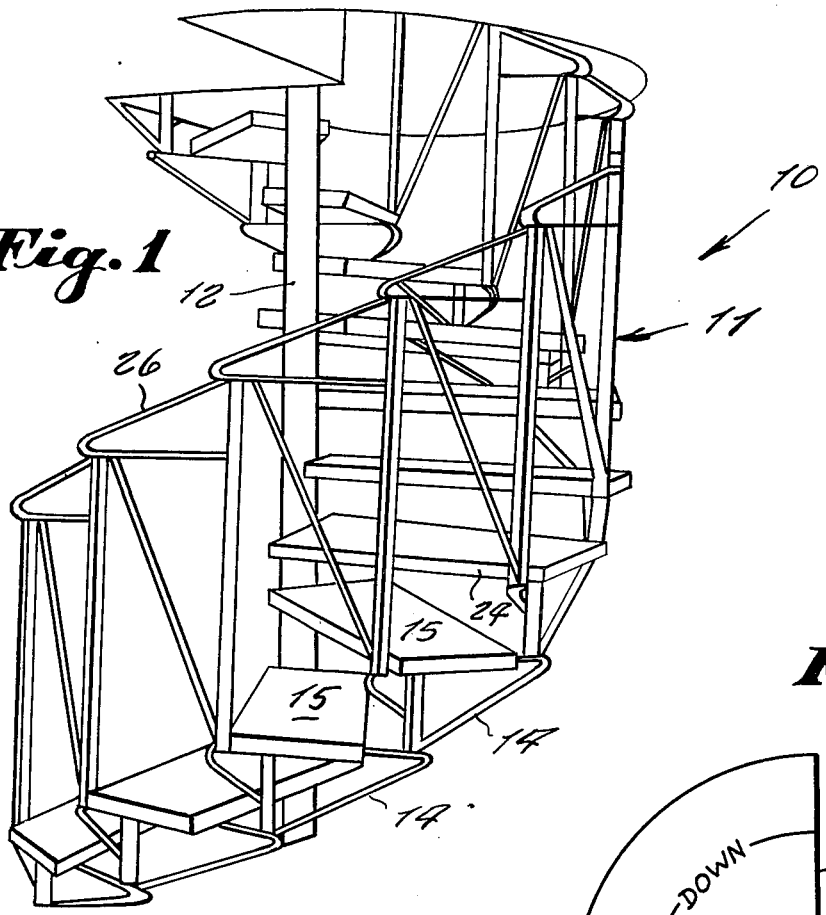
FIG. 1 is a perspective view of the invention.

Referring now to the drawings in greater detail, the reference numeral 10 represents a spiral stair kit according to the present invention which when fully setup results in a spiral staircase 11 as shown in FIG. 1.

The kit can be packaged in five boxes for convenience in shipping and includes a central column 12, a set of step-holder brackets 13, a set of step riser brackets 14, a set of templates, not shown, for cutting and drilling step treads 15 from lumber, a set of posts 16 which together with an uppermost and a lowermost posts 17 and 18 respectively form a banister of spiral shape for the staircase, braces 19 and 20 as well as a plurality of shims, lag screws, bolts, washers and other fittings, not shown or indicated.

In the construction and erection of the kit into a spiral staircase, the person must first determine what size it should be. A 6 foot staircase would have 34 inch long treads while a 5 foot staircase would have 28 inch long treads. A stairway opening for the six foot staircase would be 76 inches while for the 5 foot staircase, it would be 64 inches. Two templates are included in the kit one of which is for the 6 foot staircase and the other for the 5 foot staircase so to aid in cutting and drilling the 2 by 12 inch lumber, purchased separately from the kit, so to form the stair treads.

The kit also includes complete and detailed instructions of how to proceed in order to assemble the spiral staircase. Briefly, and without following the precise instruction in detail, the following indicates some of the steps taken at random.

The riser height must be determined so to know how many shims are to be inserted at point 21 between the riser brackets 14, so the risers are adjustable to be at seven and one-half to eight inches levels apart.

The step-holder brackets 13 are secured under one end of each tread 15. The uppermost bracket 13 is cut off at "a" for a left hand stairway or cut off at "b" for a right hand stairway, as shown in FIG. 10. The brackets 13 are secured by set screws 22 around the column 12, as also shown in FIG. 10.

The riser brackets 14 are secured at the opposite ends of the treads and are bolted together one above the other.

The posts 16 are secured at their lower ends 23 to the tread edge outer end 24. Each post 16 includes bent up metal work as shown at 25 and which bolt together so to form a banister 26. The uppermost post 17 and lowermost post 18 do not include such construction.

While temporary wood braces are used during the construction, these are removed after permanent braces 19 and 20 are installed for rigidly holding the structure together.

Figure 2:
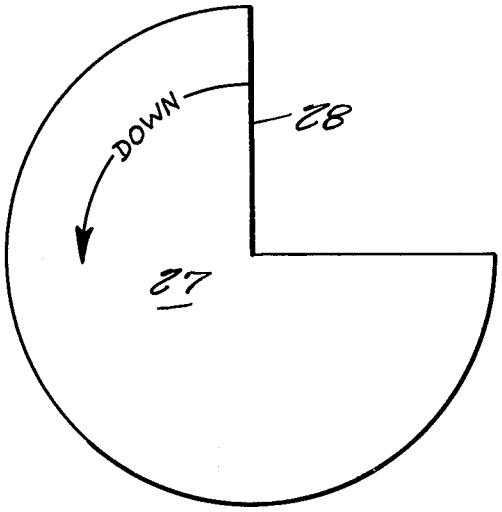
FIG. 2 is a plan view of a right hand stairway design thereof.
Figure 3:
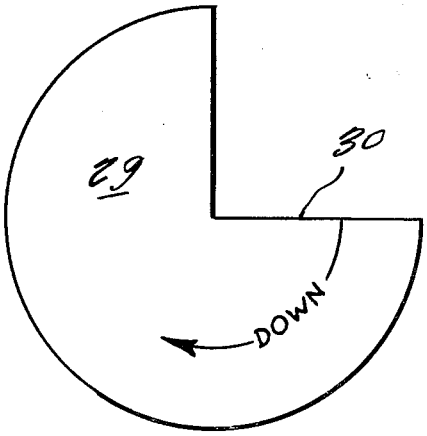
FIG. 3 is a plan view of a left hand stairway design thereof.
Figure 4:
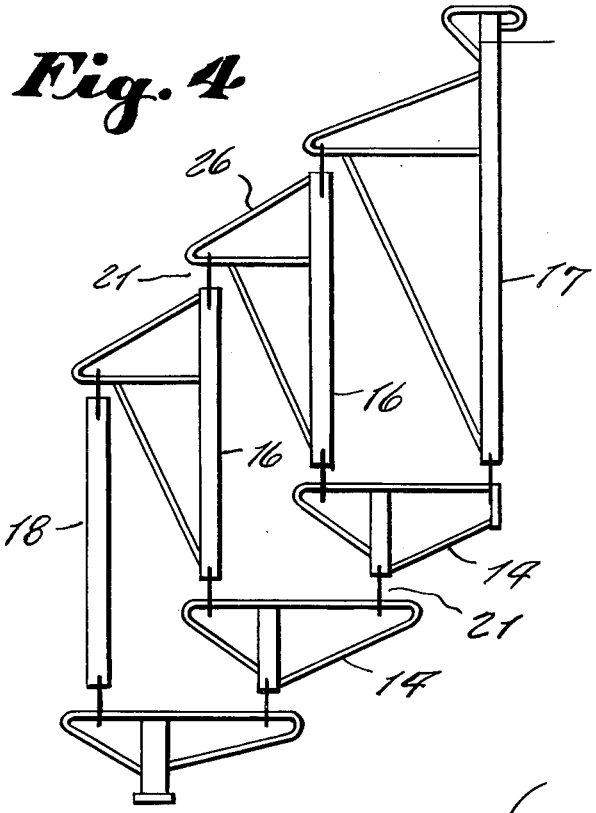
FIG. 4 is a side elevation view showing a detail assembly of the stairway construction and more particularly the posts with upper and lower brackets.
Figure 5:
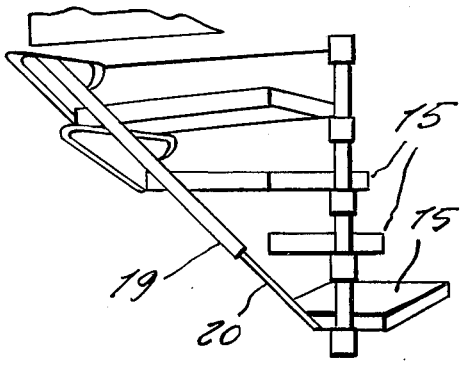
FIG. 5 is a detail assembly showing the understair bracing.

In FIG. 2 there is shown a right hand stairway 27, and a first step for going down is at 28. In FIG. 3, a left hand stairway 29 has a first step down at 30.

Figure 6:
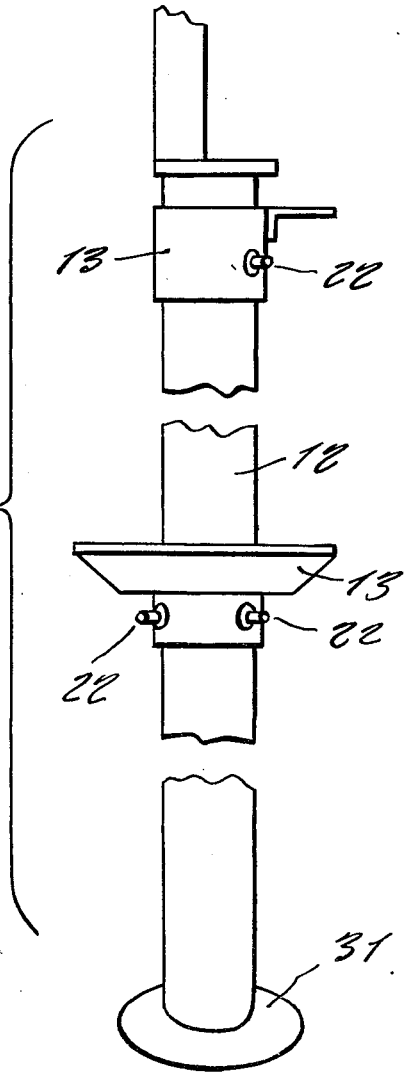
FIG. 6 is a fragmentary side view of the central column and parts secured thereto.

FIG. 6 shows that the kit can also include a base plate 31 for mounting under a lower end of the column. This other fitting may also be included so as to give a finished appearance to the structure. The treads may be painted, varnished or carpeted in any of various ways, as wished.

While various changes may be made in the detail construction, it is understood that such changes will be within the spirit and scope of the present invention as is defined by the appended claims:

What I claim is:

1. A spiral stair kit for constructing a spiral staircase having a plurality of step treads, said kit including a central column, a set of step-holder brackets adapted to be positioned about said central column and secured to said column, a set of step riser brackets, said step riser brackets adjustable with respect to each other, said step-holder brackets adapted to be secured to one end of said step treads and said step riser brackets adapted to be secured to the other end of said step treads, a set of posts, said posts having an attached portion defining a bannister segment, said posts adapted to be secured to outer ends of front edges of said step treads and said bannister segment joining other segments to form a banister, connecting braces adapted to secure the assembled staircase in a rigid manner and a quantity of hardware including shims for adjusting the height of said risers for securement of said components together.

* * * * *